US005342417A

United States Patent [19]

Pacifici et al.

[11] Patent Number: 5,342,417

[45] Date of Patent: Aug. 30, 1994

[54] METHOD OF TREATING CATIONIC DYEABLE NYLON FIBERS TO INHIBIT COLD WATER BLEED

[76] Inventors: Joseph A. Pacifici, 1609 Northlake Dr., Anderson, S.C. 29625; Daniel G. Sims, 222 Sugar Creek Rd., Greer, S.C. 29650

[21] Appl. No.: 991,327

[22] Filed: Dec. 16, 1992

[51] Int. Cl.[5] ..... D06P 3/00; D06M 23/00; D06M 101/00

[52] U.S. Cl. ..... 8/685; 8/115.56; 8/115.65; 8/673; 8/676; 8/680; 8/681; 8/924

[58] Field of Search ..... 8/115.56, 115.65, 924, 8/673, 676, 680, 681, 685

[56] References Cited

U.S. PATENT DOCUMENTS

| | | | |
|---|---|---|---|
| 3,929,405 | 12/1975 | Morris et al. | 8/39 |
| 4,599,087 | 7/1986 | Heller et al. | 8/495 |
| 4,875,901 | 10/1989 | Payet et al. | 8/115.56 |
| 4,937,123 | 6/1990 | Chang et al. | 428/96 |
| 5,085,667 | 2/1992 | Jenkins | 8/539 |

OTHER PUBLICATIONS

Textile Chemist and Colorist, AATCC, vol. 25, No. 7, Jul. 1993, pp. 133, 157, 252.

Textbook of Polymer Science, 2nd Ed., Fred W. Billmeyer, Jr., 1971, John Wiley & Sons, Inc., pp. 468–472.

Rush, J. Lee; Dyeing with Acid Dyes, Dyeing Primer: Part 2, Feb. 1980, pp. 25–27.

Harris, Paul W. and Hangey, Dale A., Stain Resist Chemistry for Nylon 6 carpet, SAC Synthesis, Nov. 1989, pp. 25–30.

*Primary Examiner*—Johann Richter
*Assistant Examiner*—Michael B. Hydorn
*Attorney, Agent, or Firm*—Kennedy & Kennedy

[57] ABSTRACT

A method for reducing the cold water bleed propensity of acid and premetallized acid dyed cationic dyeable nylon fibers which comprises treating such fibers with sulfonated anionic polymers, useful as nylon fixing agents, and cationic amine based polymers, useful as cotton fixing agents.

15 Claims, No Drawings

METHOD OF TREATING CATIONIC DYEABLE NYLON FIBERS TO INHIBIT COLD WATER BLEED

TECHNICAL FIELD

This invention relates generally to methods of treating dyed nylon fibers, and particularly to methods of treating cationic dyeable type nylon fibers that are dyed with acid dyes or premetallized acid dyes in a manner so as to inhibit their propensity to bleed in cold water.

BACKGROUND OF THE INVENTION

Natural fibers, such as cotton, wool and silk, and synthetic fibers such as nylon, acrylic and polyester, are used in the textile industry to produce apparel products such as knits and wovens, piled fabrics such as carpets, and consumer goods such as sheets and towels. These products undergo a number of processes to impart certain physical and aesthetic properties to satisfy consumer needs.

One of the major processes used in the production of textiles is that of coloration. In this process dyes are imparted to fibers to produce a myriad of visual effects on finished textile goods. Associated with the use of dyes are dye auxiliaries which aid in the dyeing process or in maintaining quality standards as defined by the end use. One of these standards is cold water bleed as measured by AATCC test method 107. Dyed textile goods display a tendency to transfer dye from fiber to fiber, yarn to yarn, and fabric to fabric when they are in aqueous contact with each other. The degree to which this transfer occurs depends on several factors such as fiber type, dye type and depth of shade. Thus one class of dye auxiliary is that which is employed to minimize or eliminate cold water bleed. These chemical auxiliaries are traditionally called "fixing agents". For example, nylon fixing agents are used to treat nylon textiles dyed with acid dyes while cotton fixing agents are used to treat cellulosic textiles dyed with fiber reactive, direct or vat dyed.

Some nylon carpet fibers are receptive to being dyed with acid dyes while other types of nylon fibers are receptive to being dyed with basic dyes which are referred to as cationic dyes. Basic, cationic dyeable nylon commonly contains $SO_3H$ or COOH groups within their polymer structure in an amount sufficient to render the nylon fiber dyeable with a basic dye. Though cationic dyeable (CD) nylons offer good stain resistant properties, particularly to acid dye type stains, they have suffered from poor lightfastness, especially in light shades. This has greatly limited their commercial utilization.

The just described problem has recently been addressed and partially solved by dyeing CD nylon fibers with acid and premetallized acid dyes as disclosed in U.S. Pat. No. 5,085,667 of William G. Jenkins. Associated with this process, however, is increased cold water bleed to levels below acceptable standards in many shades of color.

SUMMARY OF THE INVENTION

It has now been discovered that cold water bleed from acid or premetallized acid dyed cationic-dyeable nylon can be substantially improved, and in some cases even eliminated, by treatment with both a nylon fixing agent and with a cotton fixing agent. Preferably, a two step process is employed wherein the cotton fixing agent is applied after the nylon fixing agent has been applied. However, both fixing agents may be applied in a single aqueous bath to dyed nylon fibers provided that a compatibilizer is also present to prevent interaction between the two fixing agents themselves.

DETAILED DESCRIPTION

Five treatment baths were made as set forth in Table 1.

TABLE 1

| Chemical | g/1000 |
|---|---|
| Bath 1 | |
| Simcofix N-201A | 40 |
| Water | 960 |
| Sulfamic acid | adjust pH to 2.5 |
| Bath 2 | |
| Simco Coupler B | 40 |
| Water | 960 |
| Bath 3 | |
| Simcofix N-201A | 20 |
| Water | 980 |
| Sulfamic acid | adjust pH to 2.5 |
| Bath 4 | |
| Simcofix Coupler B | 20 |
| Water | 980 |
| Bath 5 | |
| Simcofix N-201A | 20 |
| HCO-200 (50%) | 20 |
| Simco Coupler B | 20 |
| Water | 940 |
| Sulfamic acid | adjust pH to 2.5 |

EXPERIMENT I

Three dark shades dyed with premetallized acid dyes, specifically dark blue, black, and dark orange, of knitted yarn sock made from duPont nylon 66 type 494 cationic dyeable nylon yarn were tested. The dark blue sock fibers were dyed with Nylanthrene Blue GLF (15% OWF), the black fibers with Intrachrome Black RPL liq (15% OWF) and the orange with Intralan yellow 2BRL-S (15% OWF). Five 12 inch long strips were cut from each shade to provide single samples. Sample 1 was not treated with any dye fixing agent. Sample 2 was treated in bath 1 that had the Simcofix N-201A, a nylon dye fixing agent produced by Simco Products, Inc. of Greenville, S.C. which is a novalac type polymer primarily used to improve 2A washfasteners and cold water bleed on nylon apparel. Sample 3 was treated in bath 2 having the Simco Coupler B, a cationic polyamine polymer which is used as a cotton dye fixing agent. Sample 4 was treated first in Bath 3 with the Simcofix N-201A and then in Bath 4 with Simco Coupler B in a two step, tandem process. Sample 5 was treated in a one step process in a bath 5 containing the Simcofix N-201A, the Simco Coupler B and HCO-200 (hydrogenated castor oil, 200 moles EO) as a compatibilizer or blocking agent to prevent reaction between the two fixing agents.

All of the samples were submerged in the baths after having first been wet out with water and extracted in a washer. Samples 2 and 3 were emerged from their treatment solutions, squeezed lightly to obtain about 50% differential wet pick up 2% chemical OWF (on weight of fiber), steamed for three minutes, then rinsed in cold water, extracted and dried. Sample 4 was emerged from the Simcofix N-201A solution, squeezed lightly to about 50% differential wet pick up (1% chemical OWF), steamed for three minutes, rinsed in cold water and extracted. It was then submerged in the Simco Coupler B bath, emerged, squeezed to about 50% differential wet pick up (1% chemical and OWF), and steamed for 15 seconds. The sample was then rinsed in cold water, extracted and dried. Finally Sample 5 was submerged in the Simcofix N-201A plus Simco Coupler B plus compatibilizer bath, emerged, squeezed lightly to about 50% differential wet pick up (3% chemical OWF) and steamed for three minutes. It was then rinsed with cold water, extracted and dried.

All of the samples were evaluated for cold water bleed propensity using AATCC Test Method 107 (1978). The following numerical ratings were determined using the AATCC Grey Scale Standard for color difference.

TABLE 2

| Shade | Sample 1 | Sample 2 | Sample 3 | Sample 4 | Sample 5 |
|---|---|---|---|---|---|
| Blue | 1 | 3 | 2 | 4–5 | 3–4 |
| Black | 2 | 4 | 3 | 5 | 4 |
| Orange | 1–2 | 3–4 | 3 | 4–5 | 4 |

*The ratings given are visual ratings using the AATCC Grey Scale Standard against an untreated, undyed control. A rating of 1 = severe Cold Water Bleed, 5 = no Cold Water Bleed.

EXPERIMENT II

This experiment was done in the same manner as Experiment I with the following exceptions:

a. Only the blue shade was used.

b. Neofix R-250® (a cationic amide polymer) from Nicca USA, Inc., Fountain Inn, S.C. was used in place of Simco Coupler B. Neofix R-250® is a cationic polyamide type polymer used as a cotton fixing agent.

c. Samples 3 and 5 were deleted.

The following numerical ratings were again determined using the same AATCC test method as before.

TABLE 3

| Shade | Sample 1 | Sample 2 | Sample 4 |
|---|---|---|---|
| Blue | 1–2 | 3–4 | 5 |

Why the cotton fixing agent is so effective here is not understood. Its effectiveness is quite unexpected since cotton fixing agents are large cationic polymers, usually polyamine or polyamides, that react with the anionic dyes used on cotton fibers to form complex salts with low solubility in water. This serves to prevent the dyes from desorbing from the cotton fibers and transferring back into an aqueous media or onto other cotton fibers, i.e. from cold water bleeding. It is speculated that the cotton fixing agent is coupling the CD nylon fibers to the nylon fixing agent due to the affinity of the cationic cotton fixing agent to the anionic fibers and anionic nylon fixing agent. Since the nylon fixing agent is holding the dyes to each other by a polymer network, the cotton fixing agent apparently is, in essence, holding the dyes to the fiber through this coupling mechanism. Though there is no proof of this yet, it is at least a theoretically plausible explanation.

It thus is seen that a method is now provided for treating CD nylon fibers dyed with acid or premetallized acid dye to inhibit their propensity for bleeding in cold water. It should of course be understood that the specific examples described only illustrate a practice of the invention in its preferred form. Many modifications, deletions, and additions may be employed without departure from the spirit and scope of the invention as set forth in the following claims.

We claim:

1. The method of reducing the cold water bleed propensity of acid and premetallized acid dyed cationic dyeable nylon fibers wherein the fibers are treated with a nylon fixing agent and with a cotton fixing agent.

2. The method of claim 1 wherein the cationic dyeable nylon fibers contain $SO_3H$ or COOH groups.

3. The method of claim 1 wherein the cationic dyeable nylon fibers are treated with a cotton fixing agent selected from the group consisting of polyamine polymers and polyamide polymers.

4. The method of claim 1 wherein the cationic dyeable nylon fibers are treated with an aqueous treatment solution that comprises said nylon fixing agent and said cotton fixing agent, and a compatibilizing agent for inhibiting reaction of the nylon fixing agent with the cotton fixing agent.

5. The method of claim 1 wherein the cationic dyeable nylon fibers are treated with an aqueous treatment solution that comprises said nylon fixing agent, said cotton dye fixing agent and a compatibilizing agent for preventing substantial reaction between the nylon fixing agent and said cotton fixing agent.

6. The method of claim 1 wherein the cationic dyeable nylon fibers are treated with the nylon fixing agent prior to being treated with the cotton fixing agent.

7. A method of reducing the cold water bleed propensity of acid and premetallized acid dyed cationic dyeable nylon fibers wherein the fibers are treated with an anionic dye fixing agent and with a cationic dye fixing agent.

8. The method of claim 7 wherein the nylon fibers are treated with the anionic dye fixing agent prior to being treated with the cationic dye fixing agent.

9. The method of claim 7 wherein the nylon fibers are treated with an aqueous treatment solution that comprises both the anionic dye fixing agent and cationic dye fixing agent and a compatibilizing agent for inhibiting reaction between the fixing agents.

10. A method of dyeing cationic dyeable nylon fibers wherein the fibers are dyed with an acid or premetallized acid dye and then treated with an anionic dye fixing agent and with a cationic dye fixing agent.

11. The method of claim 10 wherein the nylon fibers are treated with the anionic dye fixing agent prior to being treated with the cationic dye fixing agent.

12. The method of claim 10 wherein the nylon fibers are treated with an aqueous treatment solution that comprises both the anionic dye fixing agent and cationic dye fixing agent and a compatibilizing agent for inhibiting reaction between the fixing agents.

13. A method of dyeing cationic dyeable nylon fibers wherein the fibers are dyed with an acid or premetallized acid dye and then treated with a nylon fixing agent and with a cotton fixing agent.

14. The method of claim 13 wherein the fibers are treated with the nylon fixing agent prior to being treated with the cotton fixing agent.

15. The method of claim 13 wherein the nylon fibers are treated with an aqueous treatment solution that comprises said nylon fixing agent and said cotton fixing agent and a compatibilizing agent for inhibiting reaction of the nylon fixing agent with the cotton fixing agent.

* * * * *